US012241270B2

(12) United States Patent
Lafoux

(10) Patent No.: US 12,241,270 B2
(45) Date of Patent: Mar. 4, 2025

(54) DEPLOYABLE TENT PROVIDED WITH ARCHES STRESSED IN BENDING

(71) Applicant: DECATHLON, Villeneuve d'Ascq (FR)

(72) Inventor: Benjamin Lafoux, Passy (FR)

( * ) Notice: Subject to any disclaimer, the term of this patent is extended or adjusted under 35 U.S.C. 154(b) by 58 days.

(21) Appl. No.: 17/632,795

(22) PCT Filed: Jul. 23, 2020

(86) PCT No.: PCT/EP2020/070883
§ 371 (c)(1),
(2) Date: Feb. 4, 2022

(87) PCT Pub. No.: WO2021/023521
PCT Pub. Date: Feb. 11, 2021

(65) Prior Publication Data

US 2022/0275663 A1 Sep. 1, 2022

(30) Foreign Application Priority Data

Aug. 5, 2019 (FR) ..... 1908979

(51) Int. Cl.
*E04H 15/40* (2006.01)
*E04H 15/48* (2006.01)
(Continued)

(52) U.S. Cl.
CPC ..... *E04H 15/405* (2013.01); *E04H 15/48* (2013.01); *E04H 15/64* (2013.01); *E04H 2015/328* (2013.01)

(58) Field of Classification Search
CPC ..... E04H 2015/328; E04H 15/405; E04H 15/001
See application file for complete search history.

(56) References Cited

U.S. PATENT DOCUMENTS 2,677,384 A * 5/1954 Luisada ..... E04H 15/44 D21/834
4,941,499 A * 7/1990 Pelsue ..... E04H 15/42 135/156

(Continued)

FOREIGN PATENT DOCUMENTS

CA 2779782 A1 1/2013
DE 102014007427 A1 11/2015

(Continued)

OTHER PUBLICATIONS

English language abstract of EP2362037.
English language abstract of DE102014007427.
English language abstract of RU182188.

*Primary Examiner* — Noah Chandler Hawk
(74) *Attorney, Agent, or Firm* — Brian Gordaychik

(57) ABSTRACT

A deployable tent having a tent cloth, and a skeleton having at least one first arch provided with a first deformable elongate element and a second deformable elongate element that are arranged end-to-end by their first ends. The skeleton has a folded position and a deployed position, and in the deployed position, the distance between the second ends of the first and second deformable elongate elements of the first arch is less than the sum of the lengths of the first and second deformable elongate elements. The deformation in bending of the first and second deformable elongate elements of the first arch increases and then decreases during the passage between the deployed position and the folded position.

16 Claims, 7 Drawing Sheets

(51) Int. Cl.
*E04H 15/64* (2006.01)
*E04H 15/32* (2006.01)

(56) References Cited

U.S. PATENT DOCUMENTS

| | | | | |
|---|---|---|---|---|
| 6,145,527 | A * | 11/2000 | Gillis | E04H 15/425 135/124 |
| 6,415,806 | B1 | 7/2002 | Gillis | |
| 7,607,445 | B2 * | 10/2009 | von Dewitz | E04H 15/425 135/124 |
| 8,156,952 | B2 * | 4/2012 | Chesness | E04H 15/48 52/83 |
| 9,834,953 | B2 * | 12/2017 | Ways | E04H 15/48 |
| 10,138,653 | B1 | 11/2018 | Weber | |
| 2009/0084420 | A1 * | 4/2009 | Pelsue | E04H 15/48 135/96 |
| 2010/0154282 | A1 * | 6/2010 | Lau | A01M 31/025 135/123 |
| 2018/0187448 | A1 * | 7/2018 | Choi | E04H 15/48 |
| 2019/0292807 | A1 * | 9/2019 | Shin | E04H 15/16 |

FOREIGN PATENT DOCUMENTS

| | | | |
|---|---|---|---|
| EP | 2362037 | A1 | 8/2011 |
| RU | 182188 | U1 | 8/2018 |

* cited by examiner

[Fig. 1]
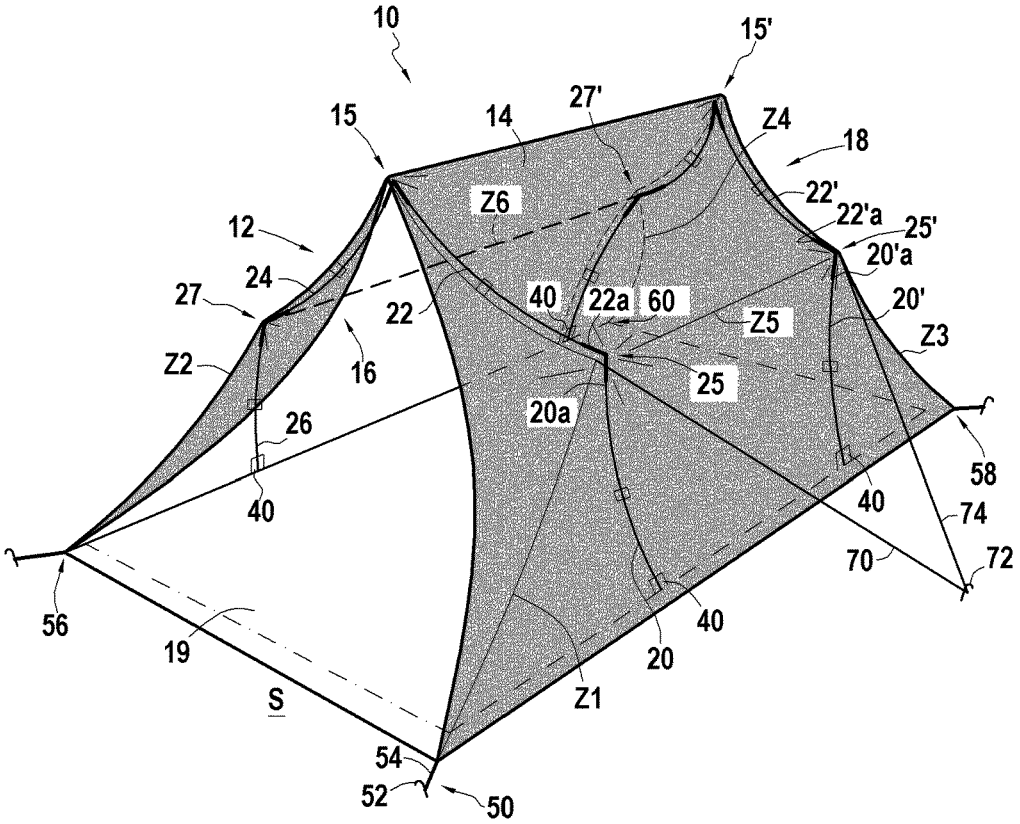

[Fig. 2]
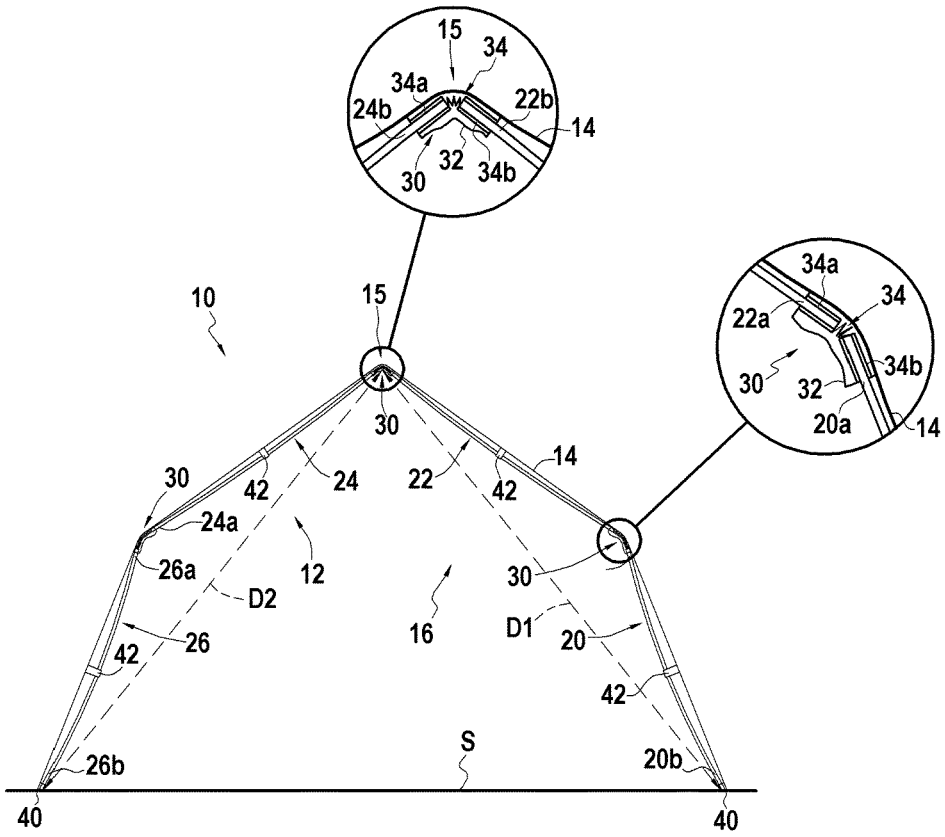

[Fig. 3]
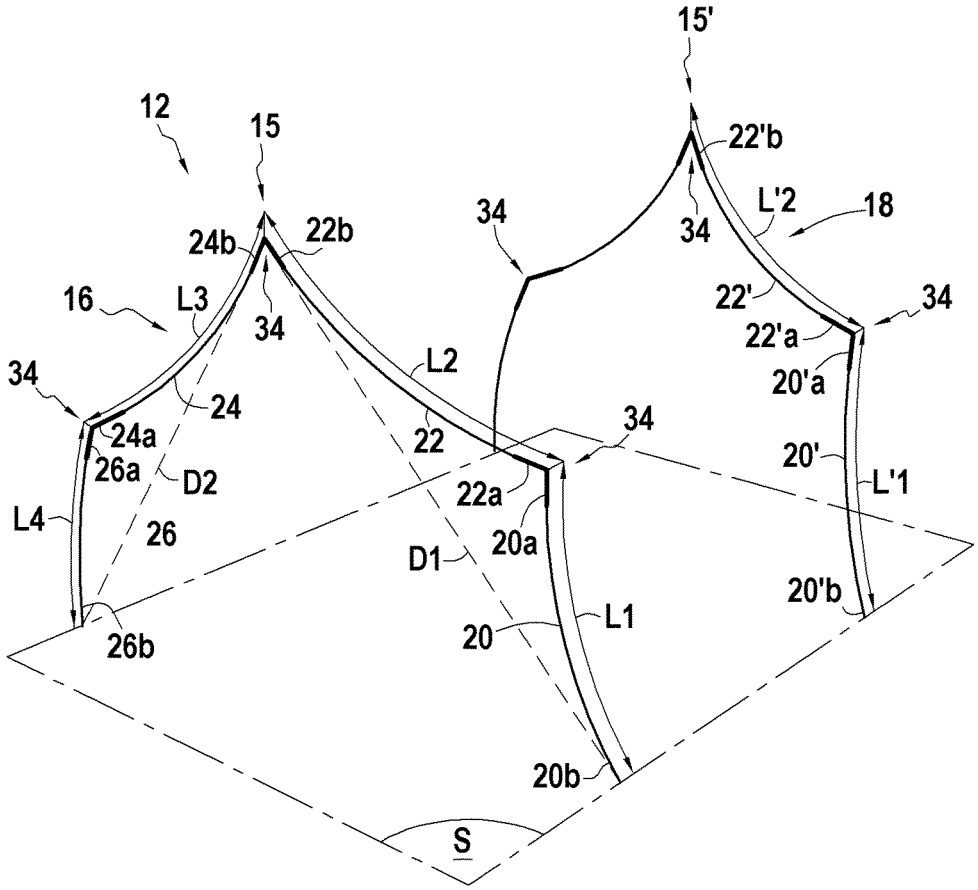
[Fig. 4]
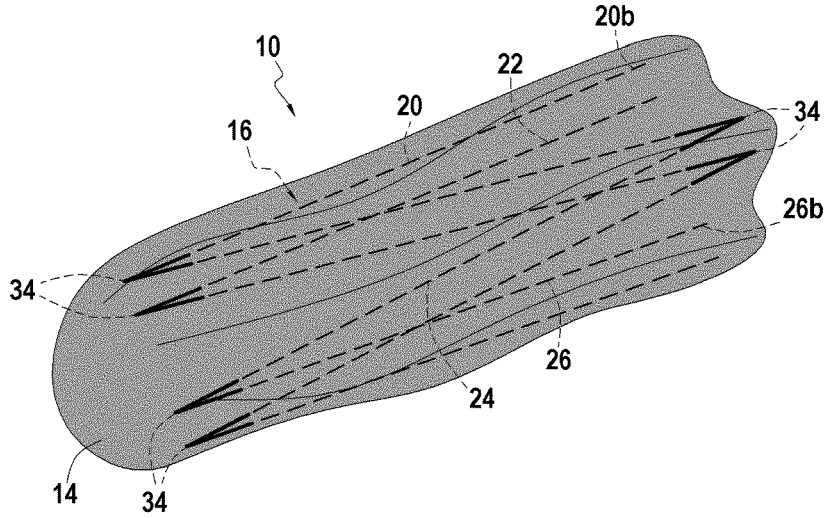

[Fig. 6]
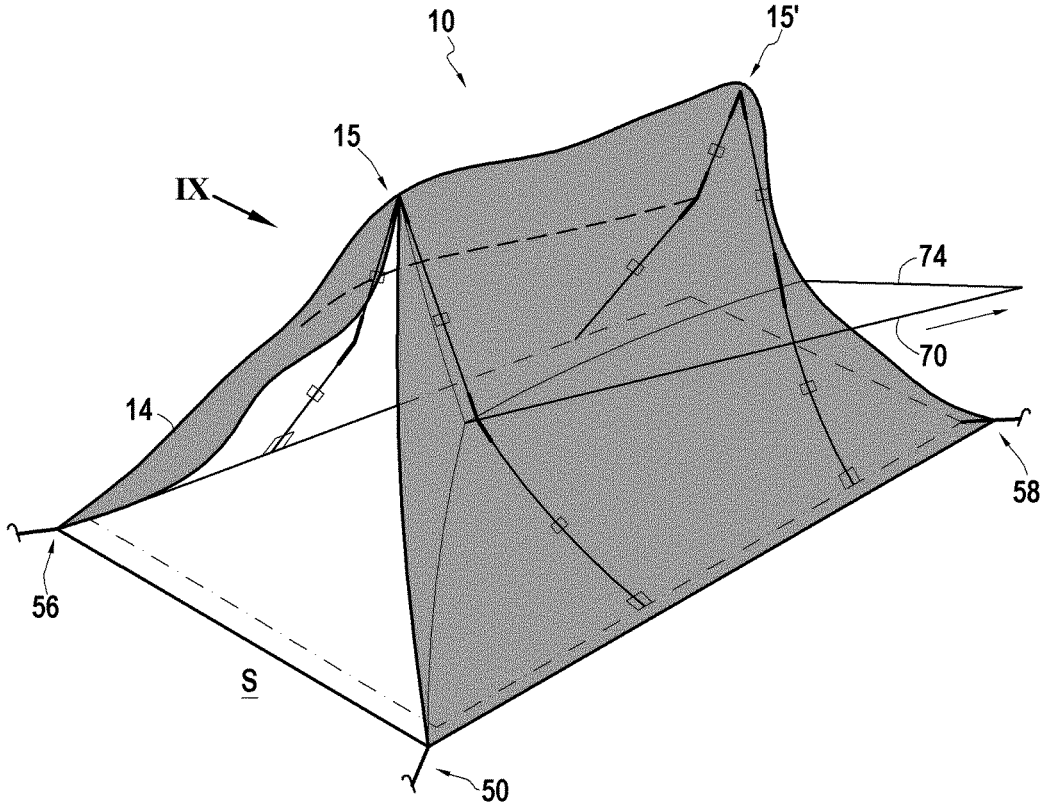
[Fig. 7]
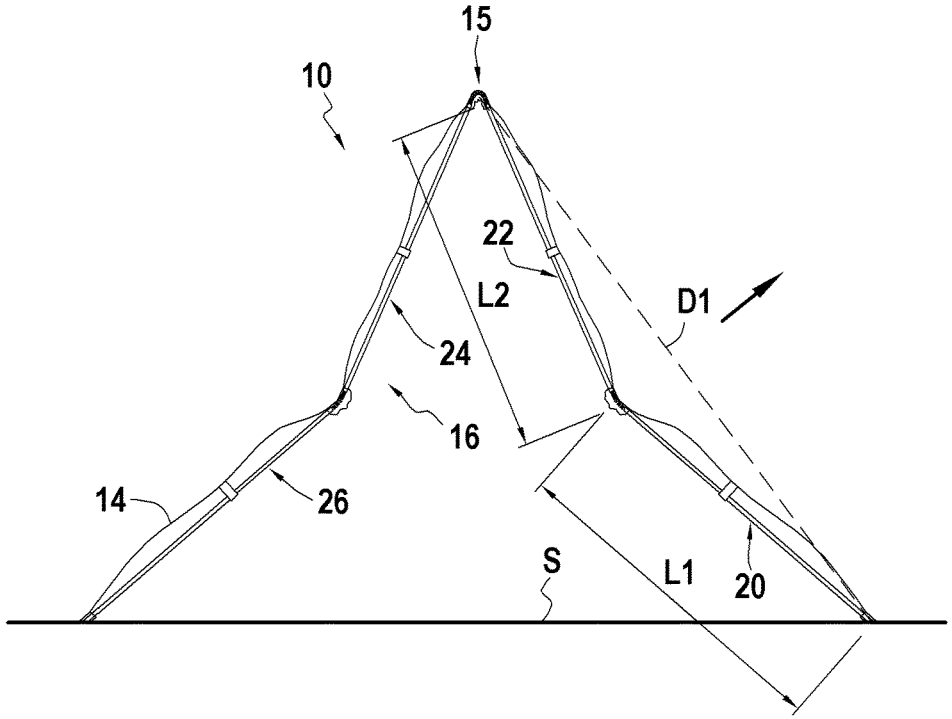

[Fig. 8]
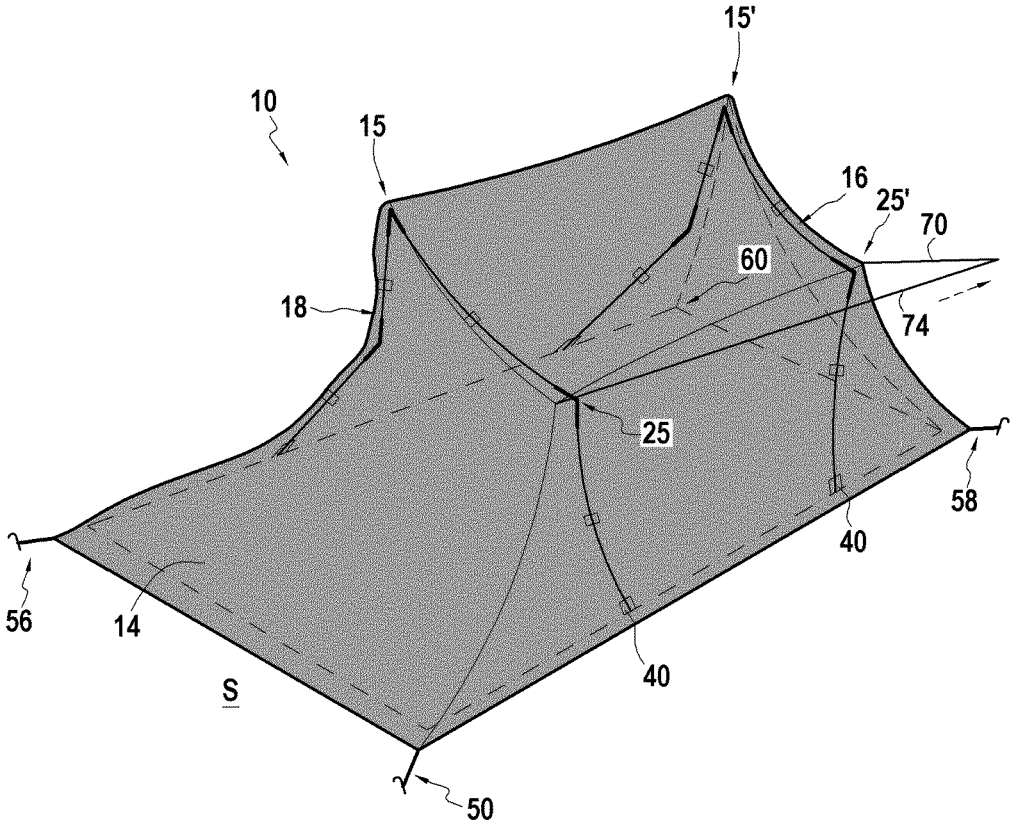
[Fig. 9]
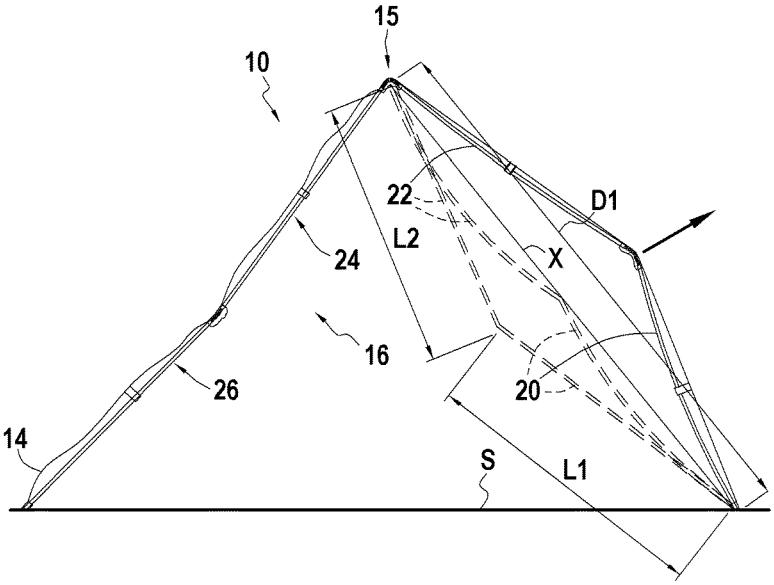

[Fig. 10]
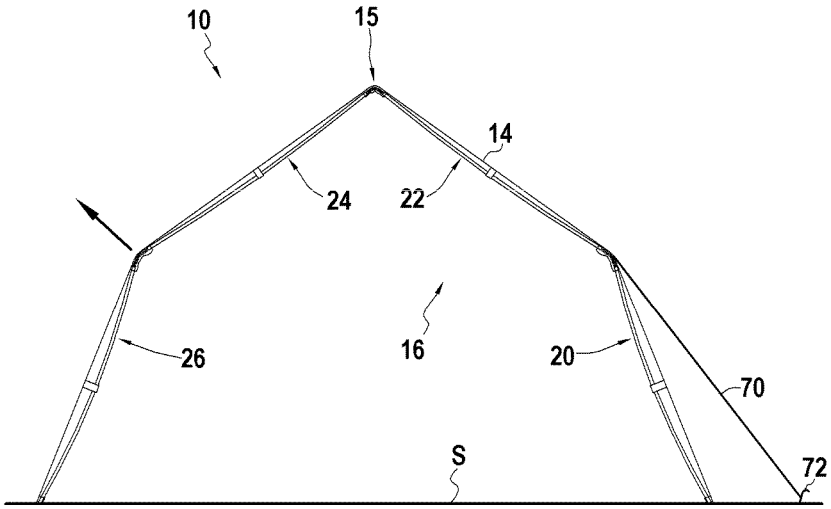
[Fig. 11]
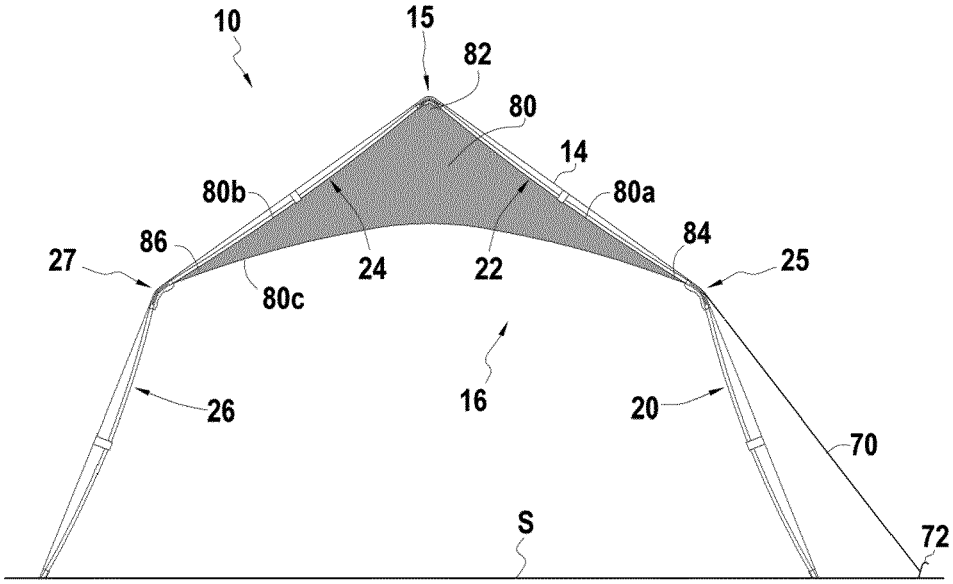

DEPLOYABLE TENT PROVIDED WITH ARCHES STRESSED IN BENDING

FIELD

The present disclosure relates to the field of deployable tents, which have the advantage of being faster to assemble and disassemble than the conventional tents.

BACKGROUND

Among the deployable tents, the pop-up type tents are known, such as the tent described in document EP1697604, which are particularly quick to assemble but whose folding mode is sometimes complex. In addition, this type of tent is relatively bulky in the folded position.

There are also known inflatable tents which are fairly quick to assemble and disassemble but which have the drawback of requiring either a source of energy to supply the inflator, or to inflate the poles using a manual inflator, which may require significant physical effort.

SUMMARY

One aim of the present disclosure is to propose a deployable tent that is quick and easy to assemble and disassemble, while being compact in the folded position.

The disclosure therefore relates to a deployable tent including a frame and a tent fabric cooperating with the frame, said frame including at least a first pole which comprises at least:

- a first deformable elongate element having a first end part and a second end part opposite to the first end part;
- a second deformable elongate element having a first end part and a second end part opposite to the first end part;
- in which the first and second deformable elongate elements of the first pole cooperate with the tent fabric and the first end parts of the first and second deformable elongate elements of the first pole are disposed end to end, in which the frame has a folded position and a deployed position, wherein, in the deployed position, the distance between the second end parts of the first and second deformable elongate elements of the first pole is less than the sum of the lengths of the first and second deformable elongate elements of the first pole, whereby the flexural deformation of the first and second deformable elongate elements of the first pole increases then decreases during the switching between the deployed position and the folded position.

Also, thanks to this arrangement, the first pole, and especially the frame, has a stable equilibrium position in the deployed position, which means that if the first pole is manipulated so as to be deformed or moved slightly while the frame is initially in the deployed position, the frame returns to the deployed position after having stopped to manipulate the first pole.

To bring the frame into the folded position from the deployed position, the user must apply sufficient force on the frame to flexurally deform the first pole in order to bring it into an intermediate unstable equilibrium position, then cross this intermediate position, following which the deformation of the first pole decreases in order to reach another position, different from the position in which it was when the frame was in the deployed position.

Also, the arrangement of the deployable tent according to the disclosure is such that the flexural deformation of the first and second deformable elongate elements of the first pole increases and then decreases during the switching from the deployed position to the folded position.

It is therefore understood that when the frame is in the deployed position, it tends to remain therein, unless the user applies sufficient force to deform the first pole and bring the frame into the folded position.

In the folded position, the first and second elongate elements can be positioned next to each other, substantially parallel to each other so that the length of the first pole in the folded position is on the order of the length of the largest of the first and second elongate elements.

It meant by "disposed end to end" within the meaning of the present disclosure that the first end parts of the first and second elongate elements are disposed in the vicinity of each other, by being in contact with each other directly or indirectly. For example, the first end parts of the first and second elongate elements can be connected to each other by a connecting element, or they can directly bear against each other.

The distance may be considered, in the deployed position, between the second ends of the first and second deformable elongate elements of the first pole, the second ends being opposite to the first end parts of the first and second deformable longitudinal elements.

The first and second elongate elements may have substantially the same length.

In the deployed position, the first and second deformable elongate elements of the first pole may exert a pressure against each other. The first and second deformable elongate elements are therefore in tension, which provides rigidity to the first pole.

The first end parts of the first and second elongate elements may exert a pressure against each other when the frame is in the deployed position.

The first and second deformable elongate elements may be held together so that, in the folded position, the kinematic connection between the first deformable elongate element and the second deformable elongate element may be of the ball joint type. This ball joint articulation facilitates the folding of the frame and allows folding the tent into a very compact volume.

According to one preferred embodiment, in the deployed position, the first and second deformable elongate elements of the first pole are flexurally deformed.

In the deployed position, at least one of the first and second deformable elongate elements of the first pole may have a concavity directed towards the outside of the tent. In other words, the intrados of said at least one of the first and second deformable elongate elements is directed towards the outside of the tent.

In the deployed position, the first and second deformable elongate elements may each have a concavity directed towards the outside of the tent.

To ensure the holding between the first and second deformable elongate elements, the deployable tent according to the disclosure further includes at least one connection device for receiving the first end parts of the first and second deformable elongate elements of the first pole.

The connection device may have a dual function, namely the holding of the first deformable elongate element relative to the second deformable elongate element on the one hand, and the transmission of the forces between the first and second deformable elongate elements on the other hand.

The connection device can include an added textile piece and/or a connection sleeve.

The connection device may be attached to the tent fabric.

According to one preferred embodiment, the connection device includes at least one sheath, fixed to the tent fabric, and receiving the first end parts of the first and second deformable elongate elements of the first pole.

The sheath may be sewn to the tent fabric on its internal face. The sheath may have two housings inclined relative to each other, each housing being fixed to the tent fabric and receiving an end part of one of the first and second deformable elongate elements.

The connection device may be arranged to allow an articulation between the first end parts of the first and second deformable elongate elements of the first pole.

The connection device may include a flexible sleeve engaged with the first end parts of the first and second deformable elongate elements of the first pole.

The flexible sleeve may be engaged in the aforementioned sheath.

The tent fabric may include a first housing, for example in the form of a pocket, in which the second end part of the first deformable elongate element is engaged when the tent is erected.

The tent fabric may include at least one tension area when the tent is deployed, said tension area cooperating at least with the first end parts of the first and second deformable elongate elements of the first pole.

The tension area participates in holding the first pole in the upright position.

The tent fabric may include a lower portion connected to the ground, and the tension area extends between the lower portion of the tent fabric and the first end parts of the first and second deformable elongate elements of the first pole. It is meant by "tension area" that the tent fabric is locally tensioned.

The tension area may be a tension line, that is to say the tension area extends substantially in a rectilinear manner.

The tent fabric may include several tension areas which extend from or between the first end parts of the deformable elongate elements, which makes it easier to hold the frame in the deployed position.

According to one preferred embodiment, each of the first and second deformable elongate elements of the first pole includes a rod. The rod can be made of fiberglass, aluminum, plastic or wood.

According to one preferred embodiment, the first and second deformable elongate elements have substantially the same length.

One advantage is that, in the folded position, the deployable tent has a generally cylindrical shape whose length corresponds substantially to the length of the deformable elongate elements.

According to one advantageous embodiment, the first pole further includes third and fourth deformable elongate elements disposed end to end, the second and third deformable elongate elements of the first pole being disposed end to end and cooperating with the tent fabric so as to define a first main tip of the tent fabric.

The first and second elongate elements disposed end to end may define a first secondary tip of the tent fabric, while the third and fourth elongate elements disposed end to end may define a second secondary tip of the tent fabric, and the tent according to the disclosure may further comprises at least one reinforcing element fixed to the tent fabric, the reinforcing element including a first part connected to the first main tip, a second part connected to the first secondary panel and a third part connected to the second secondary tip.

The reinforcing element has the effect of maintaining the distance between the first and second secondary tips in the deployed position, which allows reducing the risk of sagging of the tent under its weight when it is deployed.

The first, second and third parts may form a single piece. The reinforcing element may include of a triangular panel, the second part forming one side of said triangular panel. This panel may be, for example, a textile panel. The other sides of the panel may fixed, for example by sewing, to the tent fabric.

The tent fabric may have a second tension area extending between the first end parts of the third and fourth deformable elongate elements and a second lower portion of the tent fabric, the latter may be fixed to the ground by a second fixing member, like a peg.

The tent may further include a holding device for receiving the second end parts of the second and third deformable elongate elements. This holding device may be fixed to the tent fabric, for example an added sheath fixed to the tent fabric by sewing.

According to one preferred arrangement, the first and second deformable elongate elements on the one hand, and the third and fourth deformable elongate elements on the other hand, are disposed on either side of a vertical plane passing through the first main tip.

According to one preferred embodiment, the frame further includes a second pole which comprises at least:

- a first deformable elongate element having a first end part and a second end part opposite to the first end part;
- a second deformable elongate element having a first end part and a second end part opposite to the first end part;
- the first and second deformable elongate elements of the second pole cooperate with the tent fabric and the first end parts of the first and second deformable elongate elements of the second pole are disposed end to end,
- wherein, in the deployed position, the distance between the second end parts of the first and second deformable elongate elements of the second pole is less than the sum of the lengths of the first and second deformable elongate elements of the second pole, whereby the flexural deformation of the first and second deformable elongate elements of the second pole increases then decreases during the switching between the deployed position and the folded position.

The second pole is therefore similar to the first pole.

The tent fabric may have third and fourth tension areas, similar to the first and second tension areas. The third tension area extends between the first end parts of the first and second deformable elongate elements of the second pole and a third lower portion of the tent fabric which is connected to the ground via a third fixing member.

The fourth tension area extends between the first end parts of the third and fourth deformable elongate elements of the second pole and a fourth lower portion of the tent fabric which is connected to the ground via a fourth fixing member.

In addition, the tent fabric has a fifth tension area which extends between the first end parts of the first and second elongate elements of the first pole on the one hand, and the first end parts of the first and second elongate elements of the second pole on the other hand.

In addition, the tent fabric has a sixth tension area which extends between the first end parts of the third and fourth elongate elements of the first pole on the one hand, and the first end parts of the third and fourth elongate elements of the second pole on the other hand.

The first and second poles may be arranged so that the first, fifth and third tension areas are in the continuity of each other. Likewise, the second, sixth and fourth tension areas may be in the continuity of each other.

This configuration allows improving the holding in position of the first and second poles in the deployed position.

The frame may be devoid of a rod between the first and second poles. One advantage is to simplify the structure of the frame. This also allows lightening the structure and facilitating the assembly and disassembly of the frame. The first and second poles may therefore be connected held together by the tent fabric and not by the frame.

The tent may include a first connecting element fixed to the tent fabric in the vicinity of the first end parts of the first and second deformable elongate elements of the first pole, and at least one ground fixing member attached to the first connecting element.

The tent may further include a second connecting element fixed to the tent fabric in the vicinity of the first end parts of the first and second deformable elongate elements of the second pole, and the second ground connecting element may be connected to the ground fixing member.

The first and second connecting elements may form a single piece, and may be, for example, composed of a cord.

In the folded position, the first and second deformable elongate elements may be substantially parallel and the length of the deployable tent in the folded position may be substantially equal to the length of one of the first and second deformable elongate elements.

The tent may further include an internal chamber which is connected to the frame and/or to the tent fabric.

The tent fabric may include at least one opening forming a door to access the interior of the tent, the opening being arranged in a portion of the tent fabric which opens between the first and fourth deformable elongate elements.

BRIEF DESCRIPTION OF THE DRAWINGS

The disclosure will be better understood upon reading the following description of one embodiment of the disclosure given by way of non-limiting example, with reference to the appended drawings, in which:

FIG. 1 is a perspective view of one embodiment of the deployable tent according to the disclosure, in the deployed position;

FIG. 2 is a front view of the deployable tent of FIG. 1 in the deployed position;

FIG. 3 illustrates the tent of FIG. 1, without the tent fabric;

FIG. 4 illustrates the deployable tent of FIG. 1 in the folded position;

FIG. 6 illustrates the start of deployment of the deployable tent of FIG. 1;

FIG. 7 is a front view of the deployable tent of FIG. 6;

FIG. 8 illustrates the deployment of a lateral part of the frame;

FIG. 9 is a front view of the tent illustrated in FIG. 8 and illustrates the different shapes and positions of the first and second elongate elements which can be deformed during the deployment of the first pole;

FIG. 10 illustrates the deployment of the other side part of the frame;

and

Figure 5:
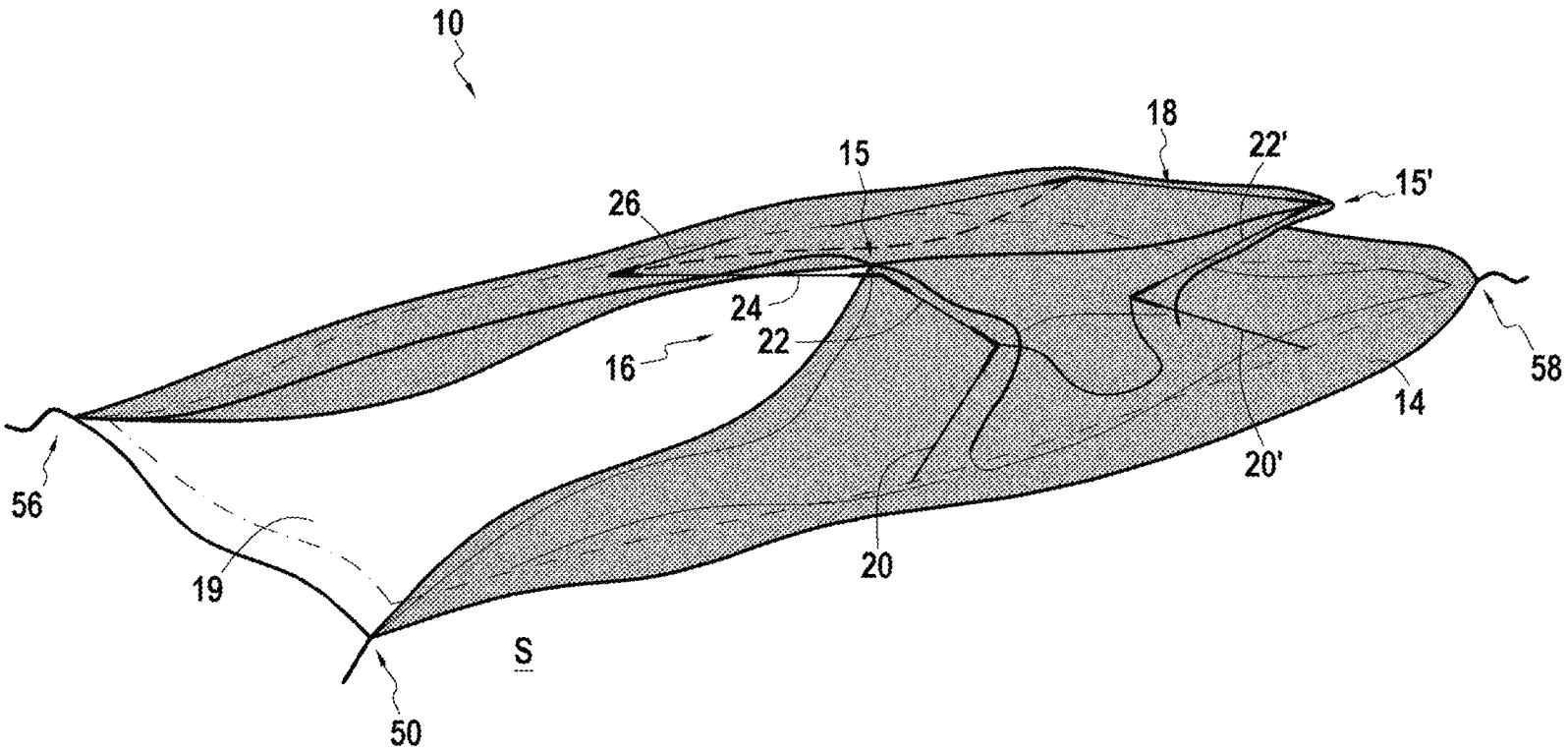
FIG. 5 illustrates the deployable tent laid on the ground, before deployment.

FIG. 11 illustrates a variant in which the deployable tent further comprises a reinforcing panel disposed under the tent fabric.

DETAILED DESCRIPTION

FIG. 1 illustrates in perspective an embodiment of a deployable tent 10 in accordance with the present disclosure. In FIG. 1, it is observed that the deployable tent 10 is in the deployed position.

The deployable tent 10 includes a frame 12, better seen in FIG. 3, as well as a tent fabric 14, cooperating with the frame 12.

In this exemplary embodiment, the frame 12 is disposed inside the tent fabric 14. However, without departing from the scope of the present disclosure, the tent fabric could be disposed inside the volume defined by the frame 12.

Accordingly, the frame 12, in this example, carries the tent fabric 14. The deployable tent 10 includes a bottom wall 19 which, in this example, forms part of the tent fabric. Without departing from the scope of the present invention, the bottom wall can also belong to an optional internal chamber, separate from the tent fabric.

The frame 12 includes a first pole 16 and a second pole 18, similar to the first pole 16. The second pole 18 is disposed at a distance from the first pole 16. As observed in FIG. 3, in the deployed position, the first and second poles 16, 18 extend substantially in two substantially vertical planes.

Referring now to FIG. 2, the first pole 16 will be described more specifically.

In accordance with the disclosure, the first pole 16 comprises a first deformable elongate element 20 having a first end part 20*a* and a second end part 20*b*, opposite to the first end part 20*a*.

The first pole 16 further comprises a second deformable elongate element 22 having a first end part 22*a*, and a second end part 22*b* opposite to the first end part.

In this example, the first pole 16 further includes a third deformable elongate element 24 including a first end part 24*a* and a second end part 24*b* opposite to the first end part 24*a*.

The first pole 16 further includes a fourth deformable elongate element 26 including a first end part 26*a* and a second end part 26*b*.

As can be seen in FIGS. 1 and 2, the first and second deformable elongate elements 20, 22 of the first pole 16 cooperate with the tent fabric 14.

Likewise, the third and fourth deformable elongate elements 24, 26 of the first pole 16 cooperate with the tent fabric 14.

In this example, the first, second, third and fourth deformable elongate elements 20, 22, 24, 26 include rods made of fiberglass, aluminum or wood. It is observed that the first end parts 20*a*, 22*a* of the first and second deformable elongate elements 20, 22 of the first pole 16 are disposed end to end, and define a first secondary tip 25 of the tent fabric when the frame is in the deployed position. Likewise, the first end parts 24*a*, 26*a* of the third and fourth deformable elongate elements 24, 26 of the first pole are disposed end to end, and define a second secondary tip 27 of the tent fabric when the frame is in the deployed position.

In the deployed position, the first and second deformable elongate elements 20, 22, of the first pole 16, are arranged to exert pressure against each other. To do so, in this example, the first end parts 20*a*, 22*a* of the first and second elongate elements 20, 22 are disposed end to end and are connected together by a connection device 30, which receives the first end parts of the first and second deformable elongate elements of the first pole.

In this example, the connection device 30 includes a sheath 32 which is fixed to the tent fabric by sewing. This sheath therefore receives the first end parts 20*a*, 22*a* of the first and second elongate elements.

It is also observed that the connection device 30 is arranged to allow an articulation between the first end parts 20*a*, 22*b* of the first and second deformable elongate elements 20, 22 of the first pole 16. As will be explained below, this articulation in particular facilitates the operations of deploying and folding the tent.

In the illustrated embodiment, the connection device further includes a flexible sleeve 34, in this example, made of plastic material, which includes two receiving portions 34*a*, 34*b* for receiving the end parts 20*a*, 22*a* of the first and second deformable elongate elements 20, 22. This flexible sleeve 34 is deformable, so as to form a flexible articulation, preferably of the ball joint type, between the first and second deformable elongate elements 20, 22. The flexible sleeve 34 also allows the first and second deformable elongate elements of the first pole 16 to exert a pressure against each other when the frame is in the deployed position.

As observed in FIG. 2, the second and third deformable elongate elements 22, 24 of the first pole 16 are disposed end to end and cooperate with the tent fabric 14 so as to define a main tip 15 of the tent fabric 14 of the deployable tent 10. More specifically, the second end parts 22*b*, 24*b* of the second and third deformable elongate elements 22, 24, are disposed end to end and are held together by another connection device 30, similar to the one that connects the first and second deformable elongate elements 20, 22. Likewise, first end parts 24*a*, 26*a* of the third and fourth deformable elongate elements 24, 26 are disposed end to end and are held together by a connection device 30.

Furthermore, the second end part 20*b* of the first deformable elongate element 20, as well as the second end part 26*b* of the fourth deformable elongate element 26, are engaged in pockets 40 fixed to the tent fabric 14.

As observed in FIG. 2, to improve the holding of the tent fabric 14 to the first pole 16, the deployable tent 10 optionally includes loops 42, fixed to the tent fabric 14, and cooperating with each of the first, second, third, fourth deformable elongate elements 20, 22, 24, 26.

Referring to FIG. 2, it is observed that the distance D1 between the second end parts 20*b*, 22*b* of the first and second deformable elongate elements 20, 22 of the first pole 16 is less than the sum of the lengths L1, L2 of the first and second deformable elongate elements 20*b*, 22*b* of the first pole 16.

In this example, the distance D1 is taken between the end of the first deformable elongate element 20, which is opposite to the second end part 20*b* of said first deformable elongate element 20, and the end of the second deformable elongate element 22 which is opposite to the first end part 22*a* of said second deformable elongate element 22.

In this example, in the deployed position, the first and second deformable elongate elements 20, 22 of the first pole 16 are flexurally deformed. They are therefore in tension because of their flexural deformation.

The same applies for the third and fourth deformable elongate elements 24, 26.

In this example, in the deployed position of the frame, the distance D2 between the second end parts 24*b*, 26*b* of the third and fourth deformable elongate elements 24, 26 of the first pole 16 is less than the sum of the lengths L3, L4 of the third and fourth deformable elongate elements 24, 26. The third and fourth deformable elongate elements 24, 26 are, in the deployed position, flexurally deformed, their concavity being directed towards the outside of the deployable tent.

In this example, the second pole 18 also comprises a first deformable elongate element 20' having a first end part 20'*a* and a second end part 20'*b* opposite to the first end part 20'*a*.

The second pole 18 further includes a second deformable elongate element 22' having a first end part 22'*a*, and a second end part 22'*b* opposite to the first end part.

The first and second deformable elongate elements 20', 22' of the second pole 18 cooperate with the tent fabric 14.

The first end parts 20'*a*, 22'*a* of the first and second deformable elongate elements 20', 22' of the second pole 18 are disposed end to end and define a third secondary tip 25' of the tent when the frame is in the deployed position.

Like the first pole 16, in the deployed position, the distance between the second end parts 20'*b*, 22'*b* of the first and second deformable elongate elements 20', 22' of the second pole 18 is less than the sum of the lengths L'1, L'2 of the first and second deformable elongate elements 20', 22' of the second pole 18.

As can be seen in FIG. 3, the second pole 18 also includes third and fourth deformable elongate elements, similar to the third and fourth deformable elongate elements 24, 26 of the first pole 16. The third and fourth elongate elements are disposed end to end and define a fourth secondary tip 27' of the tent when the frame is in the deployed position. In this example, in the deployed position, the first, second, third and fourth deformable elongate elements of the second pole are also in tension due to their flexural deformation.

The second end parts of the second and third deformable elongate elements 22', 24' for their part define a second main tip 15' of the tent fabric of the deployable tent 10.

The deployable tent 10 also includes connection devices for receiving the first end parts of the first and second deformable elongate elements 20', 22' of the second pole 18. These connection devices, which allow connecting the second pole 18 to the tent fabric 14 are, in this example, identical to those which allow connecting the first pole 16 to the tent fabric 14 so that they will not be described in more detail.

As can be understood from FIG. 3, the first and second poles 16, 18 are two elements separate from each other. Particularly, the frame 12 is devoid of connecting elements connecting together the first and second poles 16, 18. Particularly, the frame is devoid of a rod connecting together the first and second poles 16, 18.

Referring to FIG. 1, it is observed that, in the deployed position, the tent fabric includes several tension areas.

The tent fabric 14 includes a first tension area Z1 which cooperates with the first end parts 20*a*, 22*a* of the first and second deformable elongate elements 20, 22 of the first pole 16. This first tension area Z1 constitutes a tension line which extends between a lower portion 50 of the tent fabric 14 and the first end parts 20*a*, 22*a* of the first and second deformable elongate elements 20, 22 of the first pole 16. This first lower portion 50 is, in this example, fixed to the ground by means of a fixing member 52, in this case a peg, which is connected to the lower portion 50 by a loop 54.

The tent fabric also includes a second tension area Z2 which extends between a second lower portion 56 of the tent fabric which is connected to the ground, and the first end parts of the third and fourth deformable elongate elements of the first pole 16.

The tent fabric also includes third and fourth tension lines Z3, Z4, similar to the first and second tension lines Z1, Z2, which extend between the first end parts of the first, second, third and fourth deformable elongate elements of the second pole 18, and third and fourth lower portions 58, 60 of the tent fabric, which are also connected to the ground.

The first, second, third and fourth lower portions of the tent fabric 14 are located at the four corners of the lower perimeter of the tent fabric.

Moreover, as observed in FIG. 1, the tent fabric further includes a fifth tension area forming a tension line Z5 which extends between the first end parts 20*a*, 22*a*, of the first and second deformable elongate elements 20, 22 of the first pole 16, and the first end parts 20'*a*, 22'*a* of the first and second deformable elongate elements 20', 22' of the second pole 18. In other words, the fifth tension line extends between the first and third secondary tips 25, 25'.

Symmetrically, the tent fabric further includes a sixth tension area, forming a tension line Z6 which extends between the first end parts of the third and fourth deformable elongate elements 24, 26 of the first pole, and the first end parts of the third and fourth deformable elongate elements of the second pole 18. In other words, the sixth tension line extends between the second and fourth secondary tips 27, 27'.

As illustrated in FIG. 1, the tension areas Z1, Z5 and Z3 are disposed in the continuity of each other between the first lower portion 50 and the third lower portion 58 of the tent fabric. Likewise, the tension areas Z2, Z6 and Z4 are disposed in the continuity of each other between the second lower portion 56 and the fourth lower portion 58 of the tent fabric. This configuration allows improving the holding of the first, second, third and fourth secondary tips 25, 27, 25', 27'.

Referring again to FIG. 1, it is observed that the deployable tent 10 further includes a first connecting element 70 which is fixed to the tent fabric 14, in the vicinity of the first end parts 20*a*, 22*a* of the first and second deformable elongate elements 20, 22 of the first pole 16. In this example, the first connecting element is composed of a cord. There is also provided a fixing member 72, in this case a peg, which is connected to the first connecting element 70 so as to tension said connecting element 70.

The deployable tent 10 further includes a second connecting element 74 which is connected to the tent fabric 14, in the vicinity of the first end parts 20'*a*, 22'*a* of the first and second deformable elongate elements 20', 22' of the second pole 18.

In this example, the second connecting element is also composed of a cord.

The second connecting element is connected to the fixing member 72, so as to tension the second connecting element.

In this example, the first and second connecting elements 70, 74 form a single piece and are composed of a cord.

The deployable tent 10 includes, in this example, third and fourth connecting elements (not illustrated here), identical to the first and second connecting elements, and which are connected, respectively, in the vicinity of the first end parts of the third and fourth deformable elongate elements of the first pole, on the one hand, and in the vicinity of the first end parts of the third and fourth deformable elongate elements of the second pole, on the other hand.

In this example, the first, second, third and fourth deformable elongate elements of the first and second poles 16, 18, are composed of rods having substantially the same length.

FIG. 4 illustrates the deployable tent 10, in the folded position. As observed, the first, second, third, fourth deformable elongate elements of the first and second poles are substantially parallel and are disposed side by side, while being surrounded by the tent fabric 14, so that the length of the deployable tent, in the folded position, is substantially equal to, or slightly greater than, the length of the deformable elongate elements. Accordingly, when folded, the tent 10 has a very compact configuration and is easily transportable.

The deployment of the deployable tent 10 described above will now described using FIGS. 5 to 10.

FIG. 5 illustrates the shape of the deployable tent, after having unfolded the tent fabric 14, so that the bottom wall 19 extends flat on the ground S. In this initial configuration, it is understood that the frame is folded, the poles 16, 18 resting on the ground.

In this exemplary mode of implementation, the first, second, third and fourth lower portions 50, 56, 58, 60 of the tent fabric are first fixed to the ground. The tent fabric is therefore fixed to the ground, so that its lower part has a substantially rectangular shape. The user then deploys the frame by pulling the first end parts of the deformable elongate elements towards him. In this example, illustrated in FIGS. 6 and 7, the user pulls on the first and second connecting elements 70, 74. This pulling movement has the effect of flexurally deforming the deformable elongate elements so that their concavity is turned towards the outside of the tent, as illustrated.

In the pulling movement exerted by the user, the first and second deformable elongate elements in this example switch from an undeformed state, that is to say they are substantially rectilinear, to a flexural deformed state, illustrated in FIGS. 8 and 9, in which their concavity is directed towards the outside of the tent.

As can be understood with FIG. 9, during the switching from the undeformed state (folded frame) to the deformed state (deployed frame), the first and second elongate elements flexurally deform so that their flexural deformation increases until the first end parts of the first and second elongate elements cross a geometric line X connecting the second end parts of the first and second elongate elements, after which their flexural deformation decreases until the first end parts have reach a final deployed position, in which they are retained by the tent fabric. It is therefore understood that the flexural deformation of the first and second deformable elongate elements 20, 22 of the first pole 16 increases then decreases during the switching from the folded position to the deployed position.

Likewise, the flexural deformation of the first and second deformable longitudinal elements 20, 22 of the first pole 18 increases and then decreases, during the switching from the deployed position to the folded position. This means that, in the deployed position, the first and second deformable elongate elements cannot return to their initial state, insofar as, to do so, it is necessary to further flexurally deform the first and second deformable elongate elements so that they can cross the aforementioned geometric line X, which requires the intervention of the user.

It is therefore understood that the frame is held in its deployed position by the tent fabric 14 which holds the elongate elements in tension, which provides rigidity to the poles. At the same time, the tension lines contribute to improving the holding in position of the poles. Also, the frame has a stable position, as a result of which the deployable tent, in the deployed position, also has a stable position.

As explained above, the frame allows easy deployment while being compact in the folded position.

FIG. 11 illustrates one variant in which the deployable tent further includes a reinforcing element 80.

The reinforcing element 80 includes a first part 82 connected to the first main tip 15, a second part 84 connected to the first secondary tip 25 and a third part 86 connected to the second secondary tip 27. In this example, the first, second and third parts constitute a single element forming a triangular panel. This panel is for example a flexible textile panel.

The triangular panel has two sides 80*a*, 80*b* fixed to the tent fabric, for example by sewing, and a third side 80*c*, which may be arcuate or straight.

As understood in FIG. 11, the panel extends in a substantially vertical plane.

The tent can include several reinforcing elements of the same type.

The reinforcing element has the effect of maintaining the distance between the first and second secondary tips in the deployed position, which allows reducing the risk of sagging of the tent under its weight when it is deployed.

The invention claimed is:

1. A deployable tent including a frame and a tent fabric cooperating with the frame, said frame including at least a first pole which comprises at least:

a first deformable elongate element having a first end part and a second end part opposite to the first end part;

a second deformable elongate element having a first end part and a second end part opposite to the first end part;

a third deformable elongate element having a first end part and a second end part opposite to the first end part;

a fourth deformable elongate element having a first end part and a second end part opposite to the first end part;

wherein the first, second, third and fourth deformable elongate elements of the first pole cooperate with the tent fabric, the first end parts of the first and second deformable elongate elements of the first pole are disposed end to end, and the first end parts of the third and fourth deformable elongate elements of the first pole are disposed end to end, wherein the second and third deformable elongate elements of the first pole are disposed end to end and cooperate with the tent fabric so as to define a first main tip of the tent fabric, wherein the frame has a folded position and a deployed position, wherein, in the deployed position, the first and second deformable elongate elements of the first pole are flexurally deformed and exert a pressure against each other, and the third and fourth deformable elongate elements of the first pole are flexurally deformed and exert a pressure against each other, wherein the distance between the second end parts of the first and second deformable elongate elements of the first pole is less than the sum of the lengths of the first and second deformable elongate elements of the first pole, and the distance between the second end parts of the third and fourth deformable elongate elements of the first pole is less than the sum of the lengths of the third and fourth deformable elongate elements of the first pole, whereby the flexural deformation of the first, second, third and fourth deformable elongate elements of the first pole increases and then decreases during the switching between the deployed position and the folded position, wherein the frame further includes a second pole which comprises at least:

a first deformable elongate element having a first end part and a second end part opposite to the first end part;

a second deformable elongate element having a first end part and a second end part opposite to the first end part;

wherein the first and second deformable elongate elements of the second pole cooperate with the tent fabric and the first end parts of the first and second deformable elongate elements of the second pole are disposed end to end, wherein, in the deployed position, the distance between the second end parts of the first and second deformable elongate elements of the second pole is less than the sum of the lengths of the first and second deformable elongate elements of the second pole, whereby the flexural deformation of the first and second deformable elongate elements of the second pole increases and then decreases during the switching between the deployed position and the folded position, wherein, in the deployed position, the first and second poles are distant to each other and extend in two distant and non-intersecting planes;

wherein the deployable tent further includes at least one connection device for receiving the first end parts of the first and second deformable elongate elements of the first pole, and wherein the connection device includes at least one sheath, fixed to the tent fabric, for receiving the first end parts of the first and second deformable elongate elements of the first pole.

2. The deployable tent according to claim 1, wherein, in the deployed position, at least one of the first and second deformable elongate elements of the first pole has a concavity directed towards the outside of the deployable tent.

3. The deployable tent according to claim 1, wherein the connection device is attached to the tent fabric.

4. The deployable tent according to claim 1, wherein the tent fabric includes at least one tension area when the frame is deployed, said tension area cooperating at least with the first end parts of the first and second deformable elongate elements of the first pole.

5. The deployable tent according to claim 4, wherein the tent fabric includes a lower portion connected to the ground, and wherein the tension area extends between the lower portion of the tent fabric and the first end parts of the first and second deformable elongate elements of the first pole.

6. The deployable tent according to claim 1, wherein each of the first and second deformable elongate elements of the first pole includes a rod.

7. The deployable tent according to claim 1, wherein the first and second deformable elongate elements have substantially the same length.

8. The deployable tent according to claim 1, wherein the first and second elongate elements disposed end to end define a first secondary tip of the tent fabric, while the third and fourth elongate elements disposed end to end define a second secondary tip of the tent fabric, and wherein said deployable tent further comprises at least one reinforcing element fixed to the tent fabric, the reinforcing element including a first part connected to the first main tip, a second part connected to the first secondary tip and a third part connected to the second secondary tip.

9. The deployable tent according to claim 8, wherein the reinforcing element includes a triangular panel, the second part forming one side of said triangular panel.

10. The deployable tent according to claim 1, wherein the frame is devoid of a rod connecting between the first and second poles.

11. The deployable tent according to claim 1, wherein the deployable tent further includes a first connecting element fixed to the tent fabric, in the vicinity of the first end parts of the first and second deformable elongate elements of the first pole, and at least a ground fixing member connected to the first connecting element.

12. The deployable tent according to claim 11, the deployable tent further includes a second connecting element connected to the tent fabric in the vicinity of the first end parts of the first and second deformable elongate elements of the second pole, and wherein the second connecting element is connected to the fixing member.

13. The deployable tent according to claim 1, wherein, in the folded position, the first and second deformable elongate elements are substantially parallel and the length of the deployable tent in the folded position is substantially equal to the length of one of the first and second deformable elongate elements.

14. A deployable tent including a frame and a tent fabric cooperating with the frame, said frame including at least a first pole which comprises at least:

a first deformable elongate element having a first end part and a second end part opposite to the first end part;

a second deformable elongate element having a first end part and a second end part opposite to the first end part;

wherein the first and second deformable elongate elements of the first pole cooperate with the tent fabric and the first end parts of the first and second deformable elongate elements of the first pole are disposed end to end, wherein the frame has a folded position and a deployed position, wherein, in the deployed position, the distance between the second end parts of the first and second deformable elongate elements of the first pole is less than the sum of the lengths of the first and second deformable elongate elements of the first pole, whereby the flexural deformation of the first and second deformable elongate elements of the first pole increases and then decreases during the switching between the deployed position and the folded position, and wherein the deployable tent further includes a first connecting element fixed to the tent fabric, in the vicinity of the first end parts of the first and second deformable elongate elements of the first pole, and at least a ground fixing member connected to the first connecting element.

15. A deployable tent including a frame and a tent fabric cooperating with the frame, said frame including at least a first pole which comprises at least:

a first deformable elongate element having a first end part and a second end part opposite to the first end part;

a second deformable elongate element having a first end part and a second end part opposite to the first end part;

wherein the first and second deformable elongate elements of the first pole cooperate with the tent fabric and the first end parts of the first and second deformable elongate elements of the first pole are disposed end to end, wherein the frame has a folded position and a deployed position, wherein, in the deployed position, the distance between the second end parts of the first and second deformable elongate elements of the first pole is less than the sum of the lengths of the first and second deformable elongate elements of the first pole, whereby the flexural deformation of the first and second deformable elongate elements of the first pole increases and then decreases during the switching between the deployed position and the folded position, wherein the first pole further includes third and fourth deformable elongate elements cooperating with the tent fabric and being disposed end to end, wherein the second and third deformable elongate elements of the first pole are disposed end to end and cooperate with the tent fabric so as to define a first main tip of the tent fabric, wherein the first and second elongate elements disposed end to end define a first secondary tip of the tent fabric, while the third and fourth elongate elements disposed end to end define a second secondary tip of the tent fabric, wherein said deployable tent further comprises at least one reinforcing element fixed to the tent fabric, the reinforcing element including a first part connected to the first main tip, a second part connected to the first secondary tip and a third part connected to the second secondary tip, and wherein the reinforcing element includes a triangular panel, the second part forming one side of said triangular panel.

16. A deployable tent including a frame and a tent fabric cooperating with the frame, said frame including at least a first pole which comprises at least:

a first deformable elongate element having a first end part and a second end part opposite to the first end part;

a second deformable elongate element having a first end part and a second end part opposite to the first end part;

a third deformable elongate element having a first end part and a second end part opposite to the first end part;

a fourth deformable elongate element having a first end part and a second end part opposite to the first end part;

wherein the first, second, third and fourth deformable elongate elements of the first pole cooperate with the tent fabric, the first end parts of the first and second deformable elongate elements of the first pole are disposed end to end, and the first end parts of the third and fourth deformable elongate elements of the first pole are disposed end to end, wherein the second and third deformable elongate elements of the first pole are disposed end to end and cooperate with the tent fabric so as to define a first main tip of the tent fabric, wherein the frame has a folded position and a deployed position, wherein, in the deployed position, the first and second deformable elongate elements of the first pole are flexurally deformed and exert a pressure against each other, and the third and fourth deformable elongate elements of the first pole are flexurally deformed and exert a pressure against each other, wherein the distance between the second end parts of the first and second deformable elongate elements of the first pole is less than the sum of the lengths of the first and second deformable elongate elements of the first pole, and the distance between the second end parts of the third and fourth deformable elongate elements of the first pole is less than the sum of the lengths of the third and fourth deformable elongate elements of the first pole, whereby the flexural deformation of the first, second, third and fourth deformable elongate elements of the first pole increases and then decreases during the switching between the deployed position and the folded position, wherein the frame further includes a second pole which comprises at least:

a first deformable elongate element having a first end part and a second end part opposite to the first end part;

a second deformable elongate element having a first end part and a second end part opposite to the first end part;

wherein the first and second deformable elongate elements of the second pole cooperate with the tent fabric and the first end parts of the first and second deformable elongate elements of the second pole are disposed end to end, wherein, in the deployed position, the distance between the second end parts of the first and second deformable elongate elements of the second pole is less than the sum of the lengths of the first and second deformable elongate elements of the second pole, whereby the flexural deformation of the first and second deformable elongate elements of the second pole increases and then decreases during the switching between the deployed position and the folded position, wherein, in the deployed position, the first and second poles are distant to each other and extend in two distant and non-intersecting planes;

wherein the deployable tent further includes at least one connection device for receiving the first end parts of the first and second deformable elongate elements of the first pole, wherein the connection device is arranged to allow an articulation between the first end parts of the first and second deformable elongate elements of the first pole, and wherein the connection device includes a flexible sleeve engaged with the first end parts of the first and second deformable elongate elements of the first pole.

* * * * *